US009295145B1

(12) United States Patent
Folker et al.

(10) Patent No.: US 9,295,145 B1
(45) Date of Patent: Mar. 22, 2016

(54) MULTIFUNCTION MAGNETIC DEVICE WITH MULTIPLE CORES AND COILS

(71) Applicant: Universal Lighting Technologies, Inc., Madison, AL (US)

(72) Inventors: Donald Folker, Madison, AL (US); John J. Dernovsek, Madison, AL (US); Stephen D. Mays, II, Madison, AL (US); Thomas M. Poehlman, Madison, AL (US); Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/539,804

(22) Filed: Nov. 12, 2014

(51) Int. Cl.

| | |
|---|---|
| ***H01F 27/38*** | (2006.01) |
| ***H01F 38/10*** | (2006.01) |
| ***H05B 41/38*** | (2006.01) |
| ***H01F 27/24*** | (2006.01) |
| ***H05B 41/24*** | (2006.01) |

(52) U.S. Cl.
CPC ..... *H05B 41/382* (2013.01); *H01F 27/24* (2013.01); *H05B 41/245* (2013.01)

(58) Field of Classification Search
CPC ..... H01F 27/38; H01F 38/10
USPC ..... 315/257, 254, 262, 267
See application file for complete search history.

(56) References Cited

U.S. PATENT DOCUMENTS

| | | | | |
|---|---|---|---|---|
| 1,553,983 | A | 9/1925 | Casper | |
| 2,317,602 | A | 4/1943 | Hall, Jr. et al. | |
| 2,418,642 | A | 4/1947 | Huge | |
| 3,231,841 | A | 1/1966 | Ohtake | |
| 3,354,417 | A | 11/1967 | Davis | |
| 4,156,222 | A | 5/1979 | Rossman et al. | |
| 4,766,365 | A | 8/1988 | Bolduc et al. | |
| 5,119,059 | A | 6/1992 | Covi et al. | |
| 5,266,916 | A | 11/1993 | Kijima | |
| 5,313,176 | A | 5/1994 | Upadhyay | |
| 5,319,343 | A | 6/1994 | Jeffries | |
| 5,581,224 | A | 12/1996 | Yamaguchi | |
| 5,731,666 | A | 3/1998 | Folker et al. | |
| 6,323,602 | B1 * | 11/2001 | De Groot et al. | 315/276 |
| 6,611,190 | B2 | 8/2003 | Chui et al. | |
| 6,642,672 | B2 | 11/2003 | Hu et al. | |
| 6,831,545 | B2 | 12/2004 | Karbula | |
| 7,352,139 | B2 | 4/2008 | Ribarich et al. | |

(Continued)

FOREIGN PATENT DOCUMENTS

JP 10163045 A * 6/1998

*Primary Examiner* — Daniel D Chang
(74) *Attorney, Agent, or Firm* — Patterson Intellectual Property Law, P.C.; Mark J. Patterson

(57) ABSTRACT

A magnetic device includes first and second magnetic cores defining first, second, and middle legs extending between first and second back walls, an air gap defined in the middle leg. First, second, and middle legs, and first and second back walls have a substantially equal width. A first winding is located on the first leg, a second winding located on the second leg, and a third winding located on the middle leg. The magnetic device can be part of an electronic ballast circuit including an AC power source, a positive AC rail, a negative AC rail, a resonant capacitor coupled between the positive and negative AC rails, multiple positive and negative lamp terminals configured to couple to respective gas discharge lamps, and windings on a magnetic device coupled between the positive AC rail and respective positive lamp terminals. The third winding is coupled between AC power source and positive AC rail to define a resonant inductor.

8 Claims, 11 Drawing Sheets

(56) References Cited

U.S. PATENT DOCUMENTS

| | | | | |
|---|---|---|---|---|
| 7,974,069 | B2 | 7/2011 | Mao et al. | |
| 2009/0184792 | A1 | 7/2009 | Yang | |
| 2010/0103585 | A1* | 4/2010 | Mao et al. | 361/270 |
| 2014/0306788 | A1* | 10/2014 | Umetani | 336/173 |
| 2015/0123402 | A1* | 5/2015 | Wagoner et al. | 290/44 |

* cited by examiner

MULTIFUNCTION MAGNETIC DEVICE WITH MULTIPLE CORES AND COILS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: None

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to magnetic devices that include wire windings around a core. More particularly, this invention pertains to magnetic devices that transfer, balance, distribute or allocate power between different loads in an electric circuit, such as lamp ballast circuits.

Multiple gas discharge lamps may be connected on different circuit paths so that if one lamp burns out, the other lamps can remain lit. In some applications, the lamps require more power to start or ignite. In such a circuit, a lamp that ignites first may clamp the startup voltage, and other lamps connected on different circuit paths may receive insufficient startup voltage and remain unlit. There are other situations where multiple lamps on multiple parallel outputs must receive higher voltages to start or ignite, and the lamp to start first clamps the startup voltage, reducing available power for other loads.

Others have attempted to overcome such problems by providing a separate power source for each load or lamp. However, these conventional solutions add components and cost to the overall circuit application. These conventional solutions also increase the size, power consumption, and heat produced by the overall circuit application. Another solution is placing each lamp on a separate circuit with its own power source, which is also costly and adds components.

What is needed, then, are improvements in magnet devices for lamp ballast circuits.

BRIEF SUMMARY OF THE INVENTION

One aspect of the present disclosure is a magnetic device including first and second magnetic cores mated together, the first and second magnetic cores defining first, second, and middle legs extending between first and second back walls. The first leg, second leg, middle leg, and first and second back walls can have a substantially equal width. At least a first winding is located on the first leg, at least a second winding is located on the second leg, and a third winding is located on the middle leg. In some embodiments, the magnetic device can include a printed circuit board electrically connected to the first, second, and third windings. In some embodiments, the first and second magnetic cores can each have an E-core configuration.

Another aspect of the present disclosure is an electronic ballast circuit including an AC power source, a positive AC rail, and a negative AC rail coupled to the AC power source. A resonant circuit including a resonant capacitor can be coupled between the positive AC rail and the negative AC rail. First, second, third, and fourth positive lamp terminals can be configured to couple to respective gas discharge lamps. First, second, third, and fourth negative lamp terminals can be configured to couple the negative AC rail to respective gas discharge lamps. The electronic ballast circuit can include a magnetic device including first and second magnetic cores each having an E-core configuration. The first and second magnetic cores can be substantially aligned to define first, second, and middle legs extending between first and second back walls. The first leg, second leg, middle leg, and first and second back walls can have a substantially equal width. A first winding can be located on the first leg and coupled between the positive AC rail and the first positive lamp terminal. A second winding can be located on the second leg and coupled between the positive AC rail and the second positive terminal. A third winding can be located on the middle leg, the third winding coupled between the AC power source and the positive AC rail, the third winding configured to define a resonant inductor in the resonant circuit. A fourth winding can be located on the first leg and coupled between the positive AC rail and the third positive lamp terminal. A fifth winding can be located on the second leg and coupled between the positive AC rail and the fourth positive lamp terminal.

One object of the present invention is to provide a device that can transfer, balance, allocate, or distribute power between one or more loads on an electric circuit.

Another object of the invention is to provide a device capable of transferring, balancing, allocating, or distributing power between different paths of an electric circuit.

Another object of the invention is to provide a common mode choke and a differential mode choke configured on the same magnetic core.

Another object of the invention is to provide a magnetic device that can act as a starting aid for multiple gas discharge lamps on different paths of an electric circuit.

Yet another objective of the invention is to provide a magnetic device that includes a resonant inductor as well as multiple starting aid windings on the same core.

Numerous other objects, advantages and features of the present invention will be readily apparent to those of skill in the art upon a review of the following drawings and description of a preferred embodiment.

DETAILED DESCRIPTION

While the making and using of various embodiments of the present invention are discussed in detail below, it should be appreciated that the present invention provides many applicable inventive concepts that is embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. Numerical terms such as first, second, third, etc. as used herein are meant to help identify different aspects of the embodiments, but their usage does not delimit the scope of the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified.

The present invention provides a magnetic device that can be used in an electric circuit, the magnetic device having a core with multiple windings that can be configured to transfer, balance, allocate, or distribute power across multiple paths of a circuit in order to power multiple loads.

Figure 1:
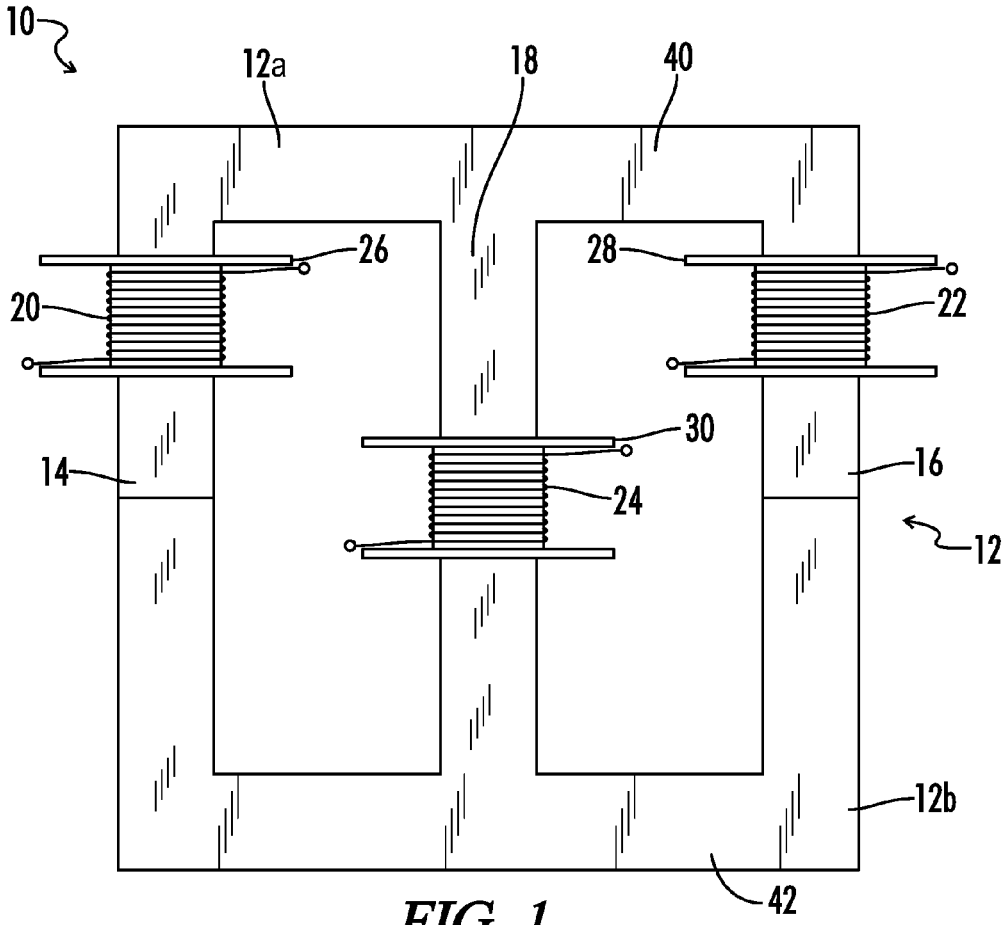
FIG. 1 is a top view of an embodiment of a magnetic device having multiple windings.

A first embodiment of a magnetic device 10 is shown in FIG. 1. The magnetic device 10 can have a magnetic core 12 including a first magnetic core 12*a* and a second magnetic core 12*b*. The first and second magnetic cores 12*a* and 12*b* can be mated together to form a first leg 14, a second leg 16, and a middle leg 18 extending between first and second back walls 40 and 42. In some embodiments the first and second legs 14 and 16 are substantially symmetric about middle leg 18. A first winding 20 is located on first leg 14. A second winding 22 is located on second leg 16. A third winding 24 is located on middle leg 18. First winding 20 and second winding 22 can be positioned such that they are magnetically coupled on magnetic core 12 when current is passed through at least one of the windings. Additionally, in some embodiments, magnetic device 10 further includes a first bobbin 26 located on first leg 14, a second bobbin 28 located on second leg 16, and a third bobbin 30 located on middle leg 18. First, second, and third windings 20, 22, 24 are located on first, second, and third bobbins 26, 28, and 30 respectively. The bobbins can be utilized to secure their respective windings on particular positions on magnetic core 12.

Figure 2:
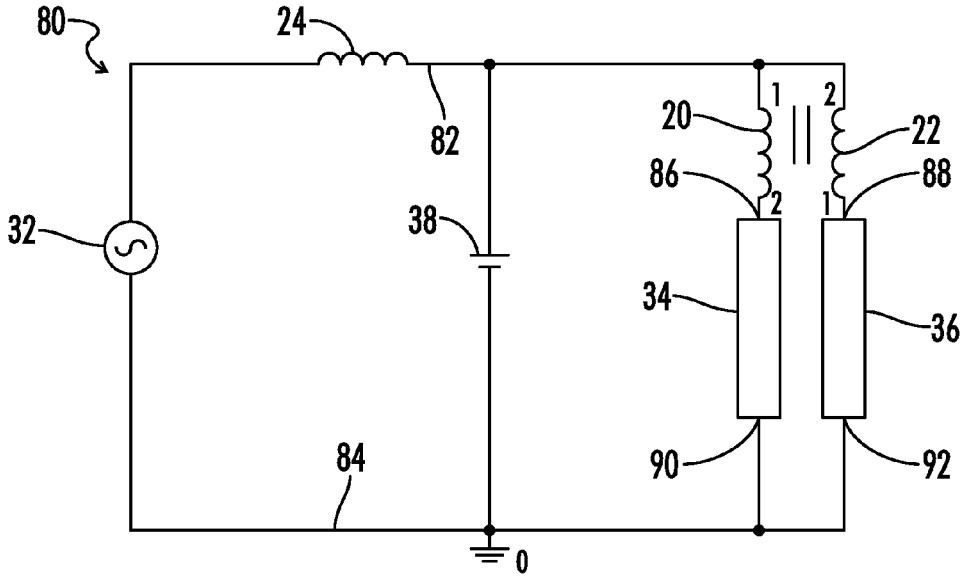
FIG. 2 is a schematic diagram of an embodiment of a circuit that can be associated with the magnetic device of FIG. 1.

An embodiment of an electronic ballast circuit 80 that may utilize the magnetic device 10 of FIG. 1 is shown in FIG. 2. The circuit can include an AC power source 32, a positive AC rail 82, and a negative AC rail 84 coupled to AC power source 32. The electronic ballast circuit 80 can include a resonant circuit including a resonant capacitor 38 coupled between positive rail AC 82 and negative AC rail 84. A first positive lamp terminal 86 can be configured to couple to a first gas discharge lamp 34. A second positive lamp terminal 88 can be configured to couple to a second gas discharge lamp 36. A first negative lamp terminal 90 can be configured to couple the negative AC rail 84 with first lamp 34. A second negative lamp terminal 92 can be configured to couple negative AC rail 84 with second lamp 36. A magnetic device as seen in FIG. 1 can be included in electronic ballast circuit 80. First winding 20 can be coupled between positive AC rail 82 and first positive lamp terminal 86. Second winding 22 can be coupled between positive AC rail 82 and second positive lamp terminal 88. Third winding 24 can be coupled between AC power source 32 and positive AC rail 82, such that third winding 24 is configured to define a resonant inductor in the resonant circuit.

AC power source 32 and an equivalent voltage produced by the resonant circuit can provide an electric current which flows to first lamp 34 and second lamp 36. First and second lamps 34 and 36 can be connected on different electrical paths such that in the event one lamp fails, the other lamp is unaffected on another current pathway, and therefore can remain lit. During startup, an excess amount of power may be supplied by the resonant circuit to ignite lamps 34 and 36. Either first lamp 34 or second lamp 36 may ignite first. The lamp that ignites first can clamp the startup voltage as it ignites, leaving insufficient startup voltage for the other lamp. For instance, assuming first lamp 34 lights first, the startup power supplied by AC power source 32 and the resonant circuit could be clamped by first lamp 34. As such, second lamp 36 may not light.

To address this problem, magnetic device 10 can be implemented in a circuit to facilitate startup of all lamps. First winding 20 on first leg 14 can be connected in series with first lamp 34. Second winding 22 on second leg 16 can be connected in series with second lamp 36. As current from the resonant circuit flows to first lamp 34, it passes through first winding 20. The current through first winding 20 induces a magnetic flux in magnetic core 12. The magnetic flux passes through core 12, and subsequently through second winding 22. The changing magnetic flux through second winding 22 induces an electric current in second winding 22, which can assists in powering second lamp 36. A similar process can be seen when second lamp 36 lights first. As such, first and second windings 20 and 22 can act as startup aids for first and second lamps 34 and 36 respectively. Additionally, as shown in FIG. 2, the polarities of the coupled first and second windings 20 and 22 are reversed, as shown by numerals 1 and 2 on the schematic diagram.

Additionally, third winding 24 on middle leg 18 can be a resonant inductor for the resonant circuit of the electronic ballast circuit 80. Thus, the magnetic device 10 can have a resonant inductor 24 as well as multiple startup aid windings 20 and 22 on the same magnetic core 12. This is a significant benefit of magnetic device 10 as conventionally the resonant inductor function and the starting aid function were performed using two different magnetic components. As such, magnetic device 10 can help minimize the overall size and cost of an electronic ballast circuit and related magnetic component.

Figure 3:
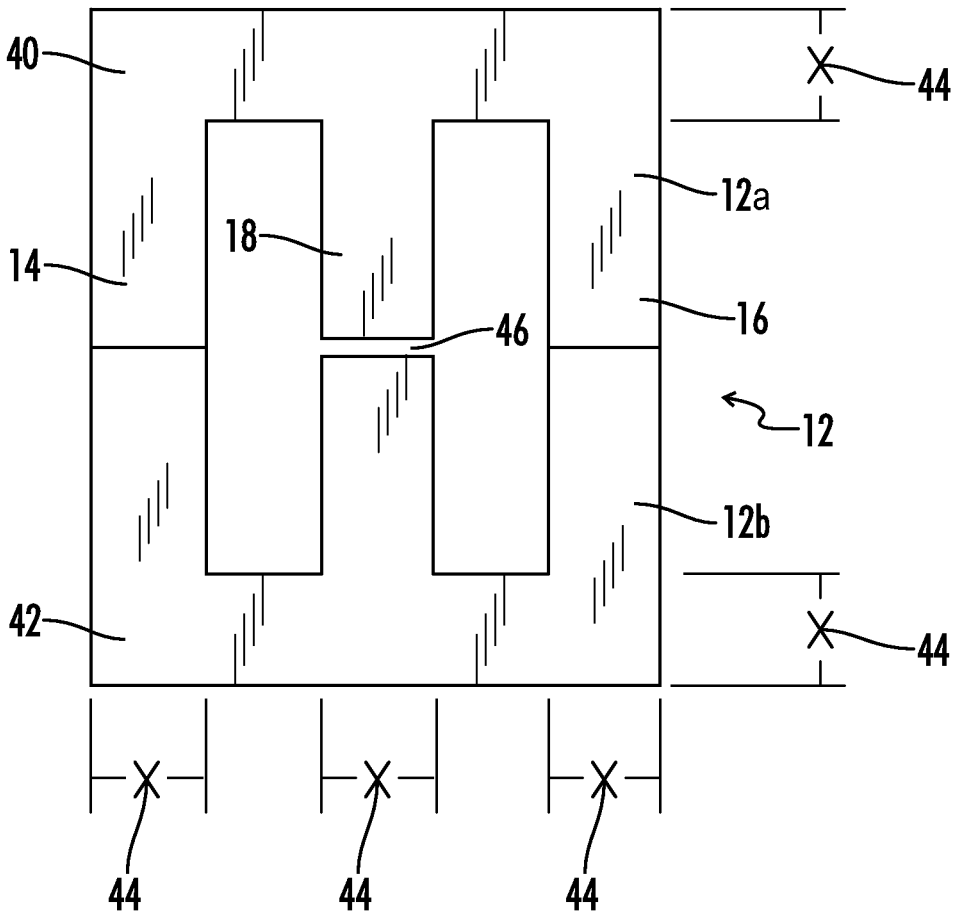
FIG. 3 is a top view of an embodiment of a modified core that can be used in a magnetic device in accordance with the present invention.

A top view of one embodiment of core 12 used in magnetic device 10 can be seen in FIG. 3. First, second, and middle legs 14, 16, and 18 can extend between first back wall 40 and a second back wall 42. In some embodiments, first leg 14, second leg 16, middle leg 18, first back wall 40, and second back wall 42 all have a substantially equal width 44. Such a core geometry can help magnetic flux in core 12 to flow through core 12 more easily and in a more uniform manner. Additionally, such a core geometry can allow multiple magnetic flux paths to flow through core 12 which can facilitate multiple functions on the same overall magnetic core 12. Additionally, core 12 can include an air gap 46 defined in middle leg 18. Air gap 46 can help prevent saturation of the magnetic flux in core 12 when current is passed through the windings.

Additionally, in some embodiments, each of magnetic cores 12*a* and 12*b* can have an E-core configuration. First back wall 40 can be located on first E-core 12*a*, and second back wall 42 can be located on second E-core 12*b*. The two E-cores 12*a* and 12*b* can be substantially aligned to form core 12. As such, the first, second, and third windings 20, 22, and 24 located on the assembled core 12 can be pre-wound on first, second, and third bobbins 26, 28, and 30, shown in FIG. 1. Subsequently, legs of the two E-cores 12*a* and 12*b* can be inserted through the bobbins 26, 28, and 30 and substantially aligned together to form the overall magnetic device 10. Being able to pre-wind the windings before magnetic device 10 is assembled can make it easier to manufacture and assemble magnetic device 10. Additionally, the middle legs of the two E-cores can be configured such that when first and second E-cores 12*a* and 12*b* are substantially aligned an air gap 46 is formed between the middle legs of the two E-cores. While core 12 in this embodiment is depicted as two E-cores, core 12 can be any suitable combination of core shapes, including an E-core mated with an I-core, or any combination of E-cores, I-cores, C-cores, U-cores, or toroidal cores.

Figure 4:
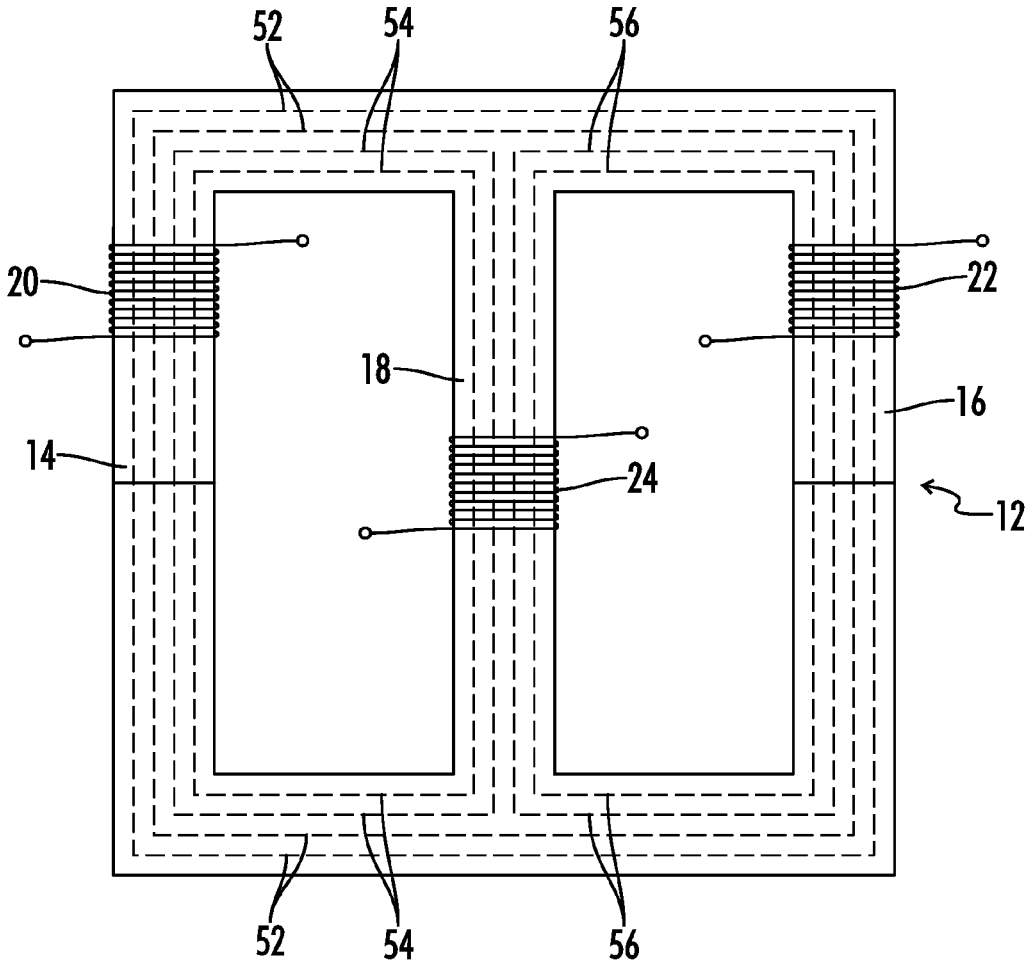
FIG. 4 is a top view of the magnetic device of FIG. 1 showing exemplary magnetic flux lines.

Examples of magnetic flux paths which can be produced in magnetic device 10 of FIG. 1 are shown in FIG. 4. A magnetic flux path can be defined as a closed loop on which magnetic flux can pass on a core 12. In some embodiments, core 12 may not have any air gaps, such that the magnetic flux loop passes continuously through core 12. In other embodiments, core 12 can include one or more air gaps, and the magnetic flux loop can pass through the magnetically permeable core 12 and traverse the air gaps.

A first flux path 52 extends through first and second legs 14 and 16 of core 12, and passes through first and second windings 20 and 22. Therefore, the first and second windings 20 and 22 are positioned on core 12 such that they are magnetically coupled via first flux path 52. When current passes through one winding, magnetic flux is produced which can flow along first flux path 52 and induce a current in the other winding.

A second flux path 54 can pass in first leg 14 and middle leg 18 and through first winding 20 and third winding 24. As such, first winding 20 and third winding 24 can be positioned on core 12 such that they are magnetically coupled together via second flux path 54.

A third flux path 56 may pass in middle leg 18 and second leg 16, and through second winding 22 and third winding 24. As such, second winding 22 and third winding 24 can be positioned on core 12 such that they are magnetically coupled together via third flux path 56.

Additionally, in some embodiments, the windings on magnetic device 10 shown in FIG. 1 can be electrically connected to electronic ballast circuit 80 of FIG. 2 to produce a common mode choke and a differential mode choke on the same core 12. First winding and second winding 20 and 22 can be connected to electronic ballast circuit 80 such that they produce a common mode choke function on the circuit as generally known in the art. The common mode choke can function as an AC inductor. Additionally, third winding 26 on middle leg 18 can be connected to the electronic ballast circuit 80 such that it produces a differential mode choke function on the circuit also as generally known in the art. The differential mode choke can function as a DC inductor. Thus, one core 12 can be used to perform two separate choke functions, which can minimize overall size and cost of the magnetic device.

Figure 5:
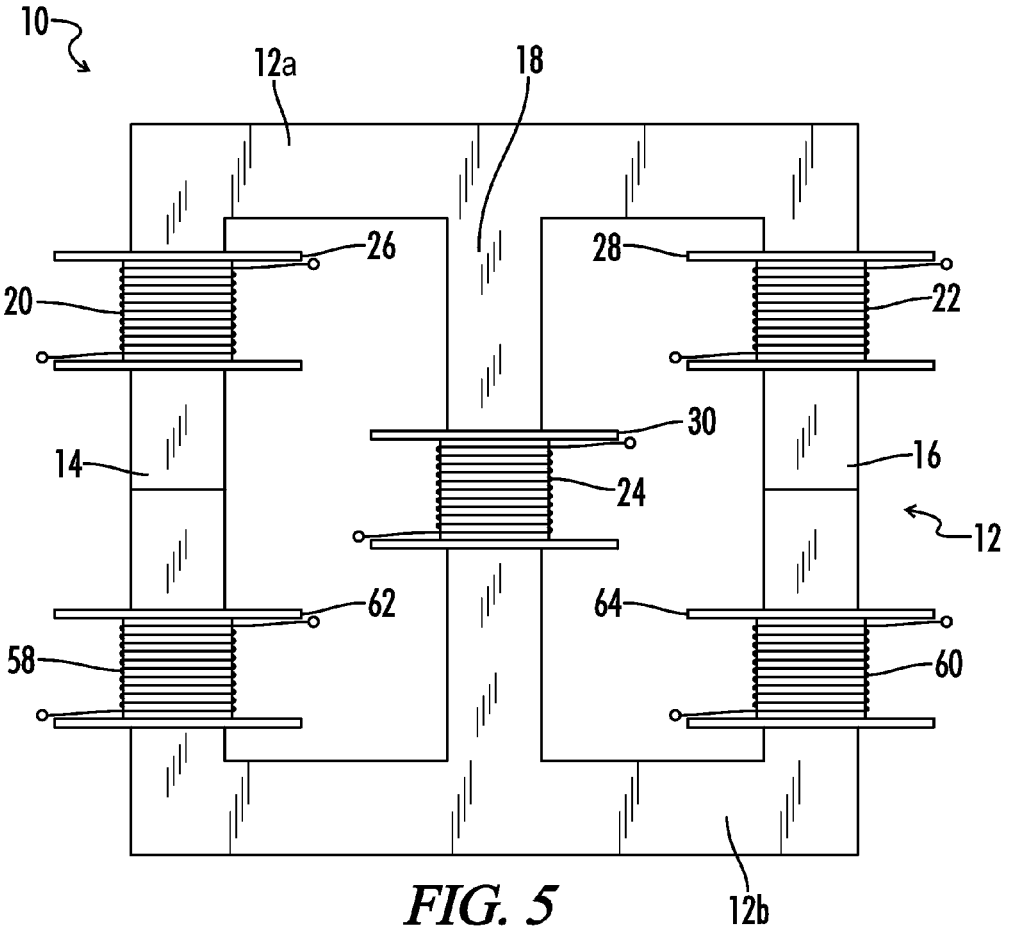
FIG. 5 is a top view of another embodiment of a magnetic device having five windings.

A second embodiment of magnetic device 10 is shown in FIG. 5. This embodiment is similar to the magnetic device of FIG. 1, but includes five windings on core 12. Fourth winding 58 can be located on first leg 14 of core 12. Fifth winding 60 can also be located on second leg 16 of core 12. Fourth and fifth windings 58 and 60 can be positioned on core 12 such that they are also magnetically coupled with first and second windings 20 and 22. The flux paths that can be produce in the embodiment of FIG. 5 are similar to the flux paths for the first embodiment shown in FIG. 4. As such, first flux path 52 can pass through the first, second, fourth, and fifth windings 20, 22, 58, and 60 respectively. When current passes through any one of these windings, a magnetic flux is produced that flows through the remaining windings along first flux path 52, thereby inducing a current in each of the remaining windings. Additionally, second flux path 54 passes through first, third, and fourth windings 20, 24, and 58, and third flux path 56 passes through second, third, and fifth windings 22, 24, and 60.

Furthermore, the second embodiment of magnetic device 10 can include a fourth bobbin 62 and a fifth bobbin 64 located on core 12. Fourth winding 58 and fifth winding 60 can be located on fourth bobbin 62 and fifth bobbin 64 respectively. Fourth bobbin and fifth bobbin 62 and 64 can help contain fourth and fifth windings 58 and 60 to their respective locations on core 12.

Figure 6:
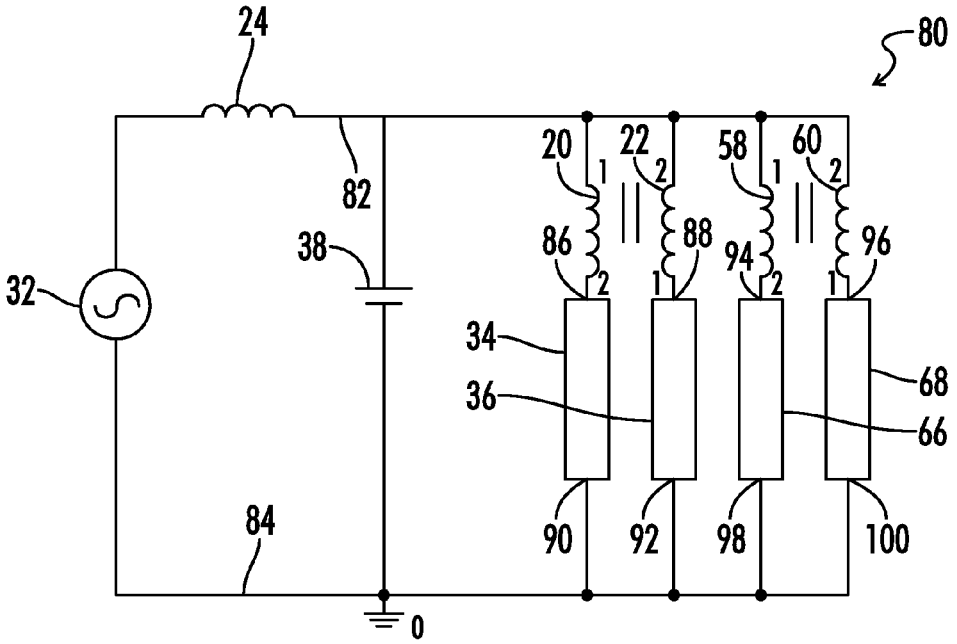
FIG. 6 is a schematic diagram of an embodiment of an electronic ballast circuit that can be associated with the magnetic device of FIG. 5.

An embodiment of an electronic ballast circuit 80 which can utilize the magnetic device of FIG. 5 is shown in FIG. 6. A third positive lamp terminal 94 can be configured to couple to a third discharge lamp 66. A fourth positive lamp terminal 96 can be configured to couple to a fourth gas discharge lamp 68. As such, first, second, third, and fourth positive lamp terminals 86, 88, 94, 96 can be configured to couple to respective gas discharge lamps 34, 36, 66, 68. A third negative lamp terminal 98 can be configured to couple negative AC rail 84 to third lamp 66. A fourth negative lamp terminal 100 can be configured to couple negative AC rail 84 to fourth lamp 68. As such, first, second, third, and fourth negative lamp terminals 90, 92, 98, 100 can be configured to couple negative AC rail 84 to respective gas discharge lamps 34, 36, 66, 68. Fourth winding 58 can be coupled between positive AC rail 82 and third positive lamp terminal 94. Fifth winding 60 can be coupled between positive AC rail 82 and fourth positive lamp terminal 100. As such, fourth and fifth windings 58 and 60 can be connected in series with lamps 66 and 68. As previously described, without the windings connected in series with the lamps, the first lamp to ignite during the startup process would effectively clamp the excess voltage and the remaining lamps would remain unlit.

With the magnetic device connected to the circuit, and the windings connected in series with the lamps, as a first lamp is ignited, current passes through the winding associated with that lamp, either the first, second, fourth, or fifth windings 20, 22, 58, or 60. A magnetic flux is created in core 12 which extends along first flux path 52 and passes through the remaining windings. The changing magnetic flux in first flux path 52 can induce current in each of the other three windings, and the currents induced in the other three windings can assist in lighting the corresponding lamps. As such, the first, second, fourth, and fifth windings 20, 22, 58, and 60 can be configured to act as startup aids for corresponding lamps when current passes through any one of the windings. Again, the polarities of the windings, represent by numerals 1 and 2, are reversed for each coupled pair of windings in the circuit.

In the circuit 80 shown in FIG. 6, magnetic device 10 can include a resonant inductor 24 and four starting aid windings 20, 22, 58, and 60 on the same magnetic core. The concepts shown in FIG. 2 and FIG. 6 can be extrapolated to accommodate larger or more numerous loads or ballasts. As such, core 12 could be configured to accommodate more starting aid windings which are all magnetically coupled on the core and connected in series to additional lamps which can be powered by the magnetic flux produced by one of the windings associated with the lamp that lights first.

Figure 7:
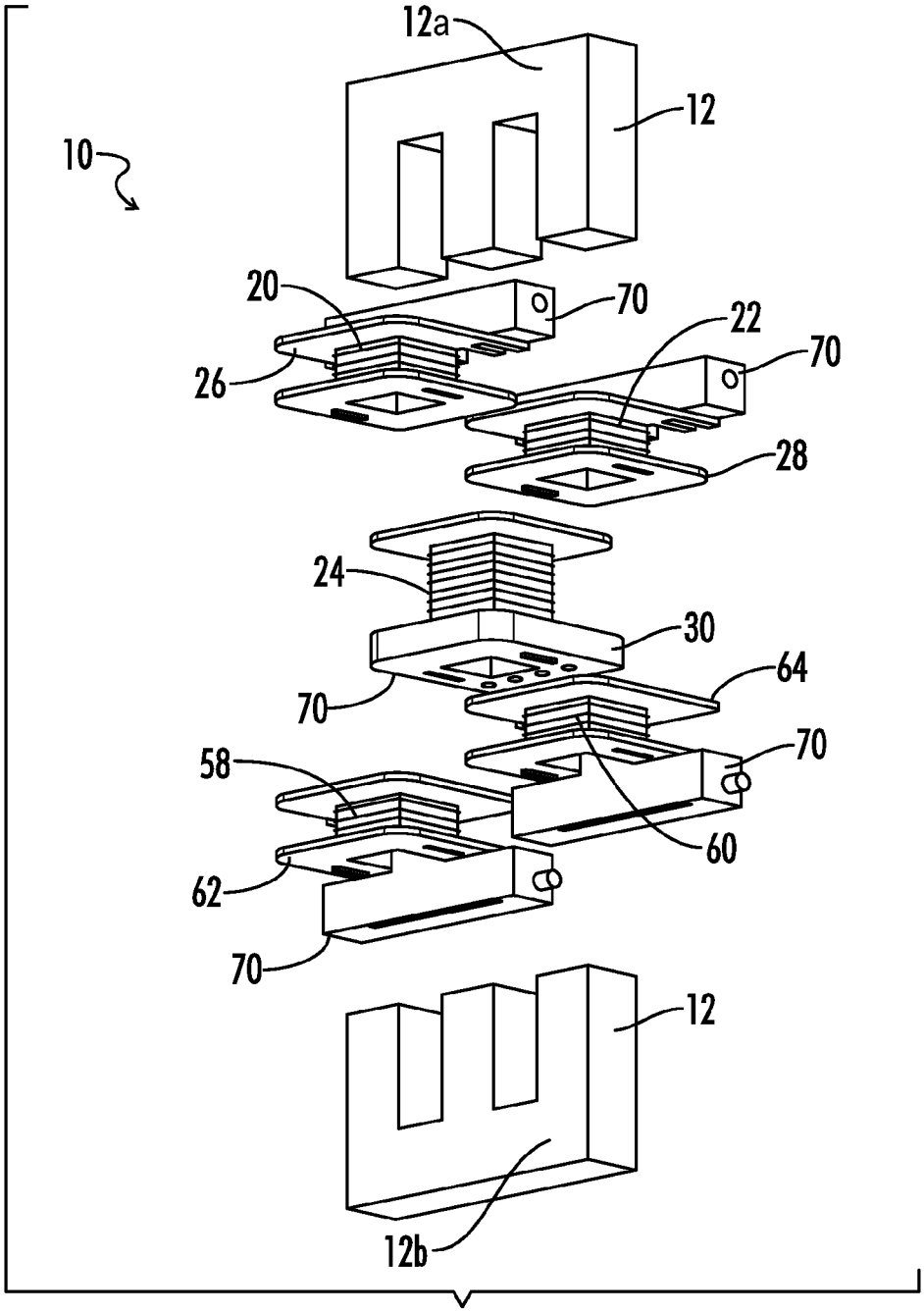
FIG. 7 is a perspective exploded view of the device of FIG. 5.
Figure 8:
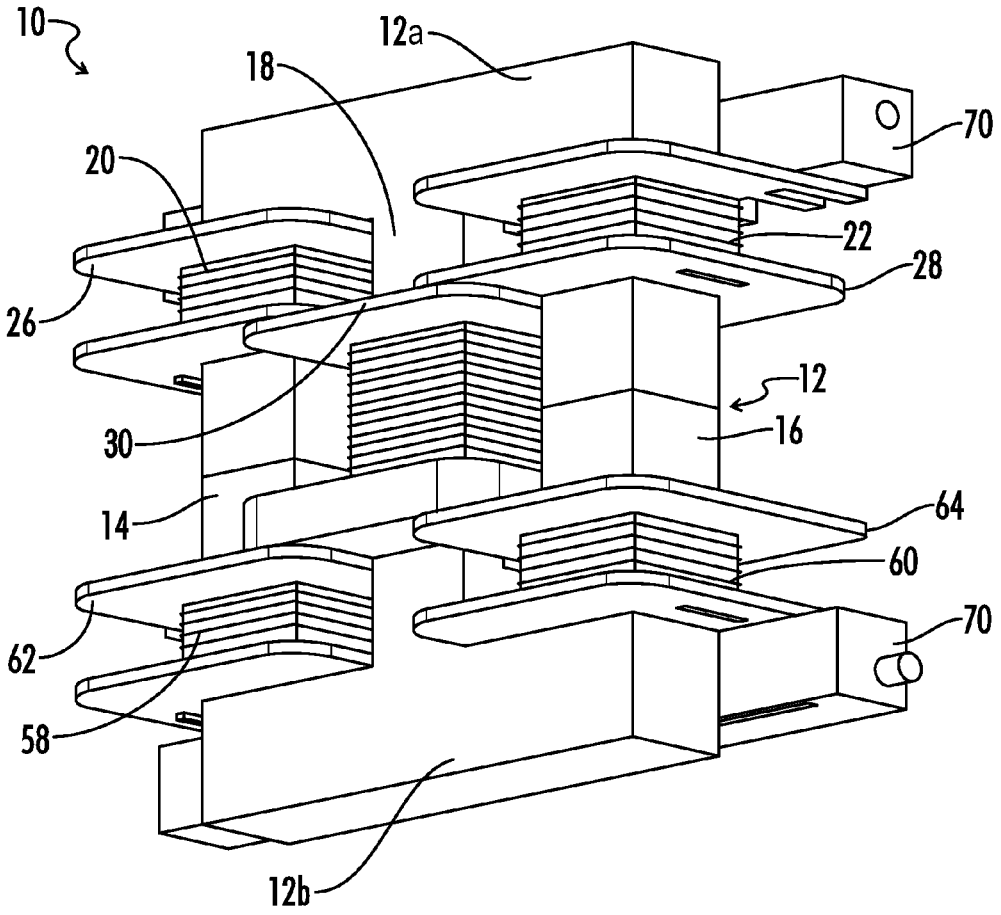
FIG. 8 is a perspective view of the magnetic device of FIG. 7 assembled.

A perspective exploded view of an embodiment of the magnetic device 10 of FIG. 5 is shown in FIG. 7. First, second, third, fourth and fifth bobbins 26, 28, 30, 62, and 64 are positioned to receive first magnetic core 12*a* and second magnetic core 12*b*. First, second, third, fourth, and fifth windings 20, 22, 24, 58, and 60 can be placed on their respective bobbins. First core 12*a* and second core 12*b* can then be inserted through the bobbins and mated together to form magnetic device 10. In some embodiments, the bobbins may also include pin rails 70 having termination connectors or pins (not shown in FIG. 7) which allow the bobbins and the windings of magnetic device 10 to be connected to a printed circuit board, which can define an electrical circuit. The ends of the windings can be connected to the termination connectors or pins on the pin rails 70, and the termination connectors or pins can then be connected to a printed circuit board. A perspective view of magnetic device 10 of FIG. 7 assembled is shown in FIG. 8.

Additionally, as shown in FIG. 6, the windings in magnetic device 10 of FIG. 5 can be electrically connected in the electronic ballast circuit 80 in order to produce a common mode choke and a differential mode choke on the same core. First, second, fourth, and fifth windings 20, 22, 58, and 60 can be connected to a circuit such that they produce a common mode choke on the circuit as generally known in the art. The common mode choke can function as an AC inductor. Third winding 26 on middle leg 18 can again be connected to the same circuit such that it produces a differential mode choke on the circuit also as generally known in the art. The differential mode choke can function as a DC inductor. Thus, one core can again be used to perform two separate choke functions.

Figure 9:
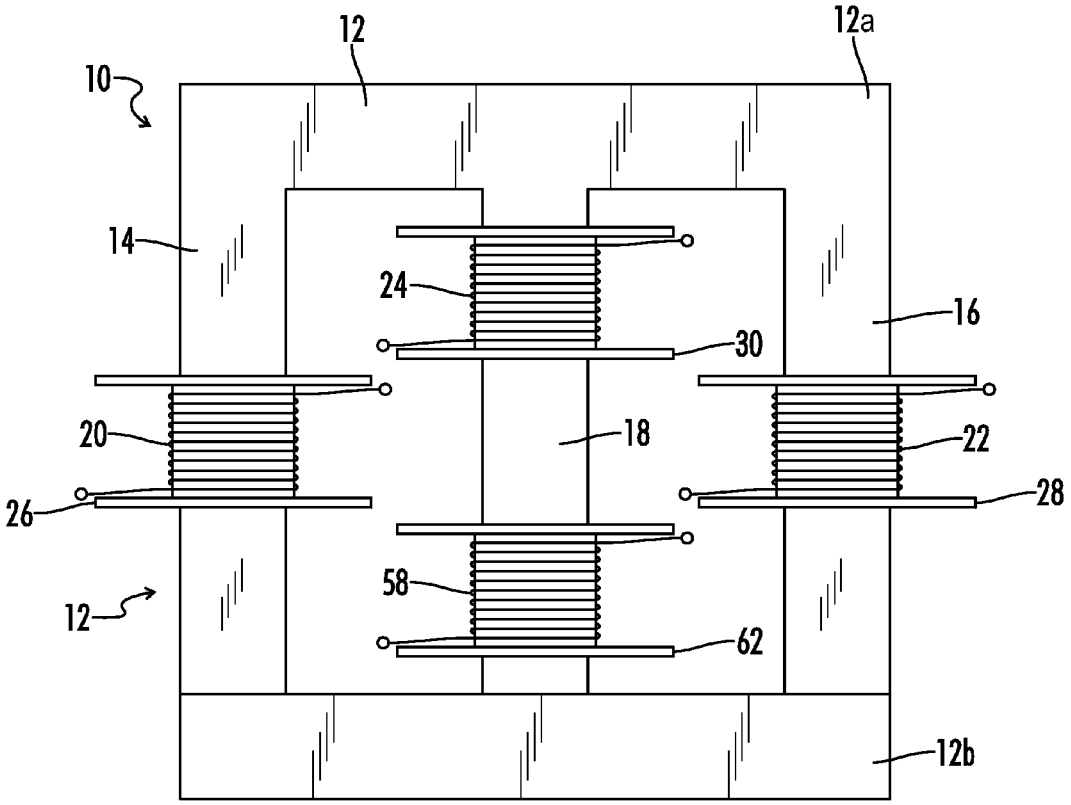
FIG. 9 is a top view of another embodiment of a magnetic device having four windings.

A third embodiment of magnetic device 10 is shown in FIG. 9. The embodiment shown in FIG. 9 is similar to the embodiment shown in FIG. 1, except a fourth winding 58 is located on middle leg 18. Additionally, in some embodiments a fourth bobbin 62 can be located on middle leg 18 and fourth winding 58 can be located on fourth bobbin 62. Fourth bobbin 62 can contain fourth winding 58 to a specific location on middle leg 18. First magnetic core 12*a* can have an E-core configuration, and second magnetic core 12*b* can have an I-core configuration. In other embodiments, core 12 can be two E-cores mated together.

The flux paths that can be produce in the embodiment of FIG. 9 are similar to the flux paths for the first embodiment shown in FIG. 4. As such, first flux path 52 passes through the first and second windings 20 and 22 respectively. When current passes through any one of these windings, a magnetic flux is produced that flows through the remaining windings along first flux path 52, thereby inducing a current in each of the remaining windings. Similarly, second flux path 54 passes through first, third, and fourth windings 20, 24, and 58, and third flux path 56 passes through second, third, and fourth windings 22, 24, and 58. As such, all four windings are magnetically coupled together through the various flux paths.

Figure 10:
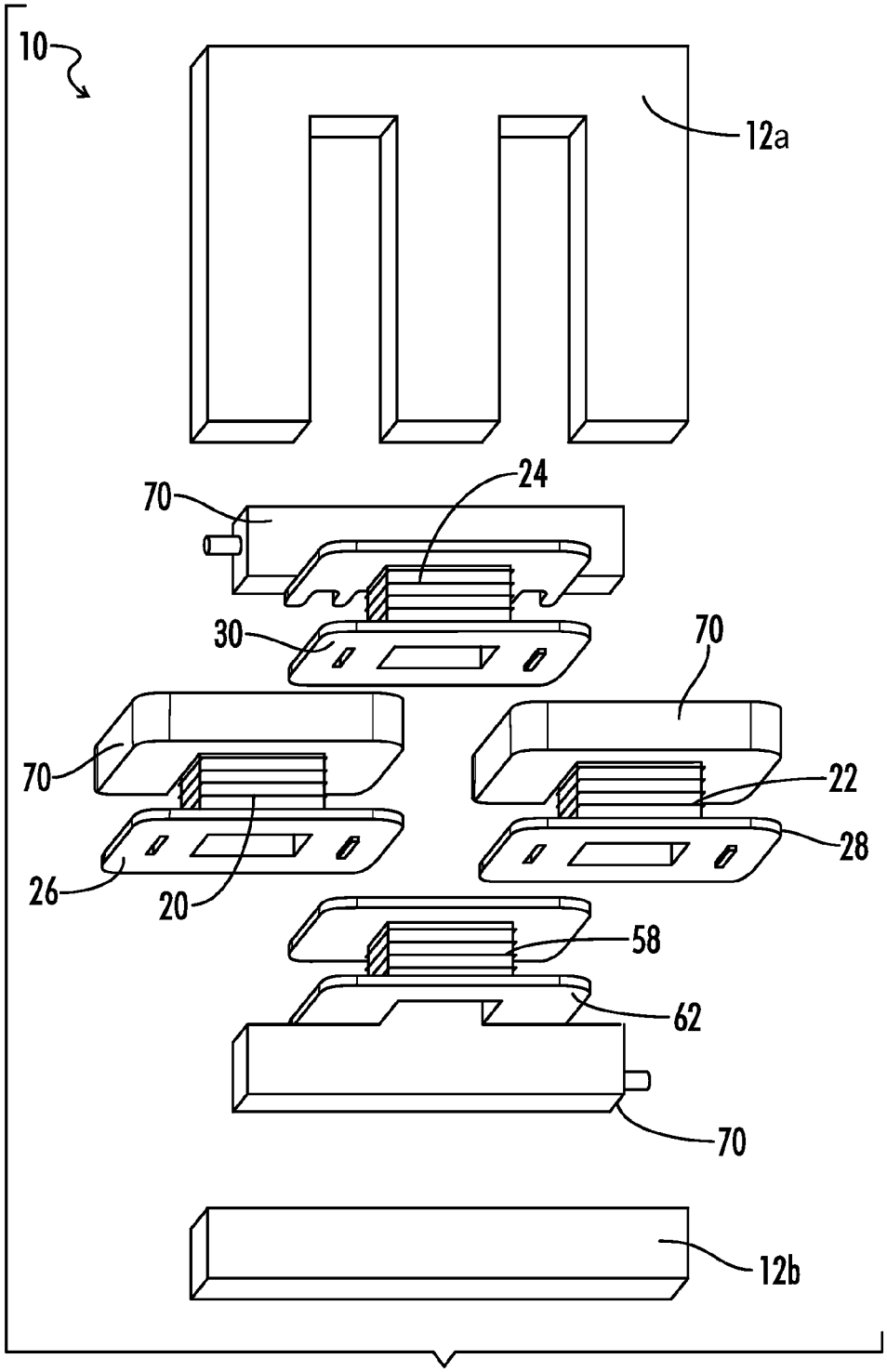
FIG. 10 is a perspective exploded view of the device of FIG. 9.
Figure 11:
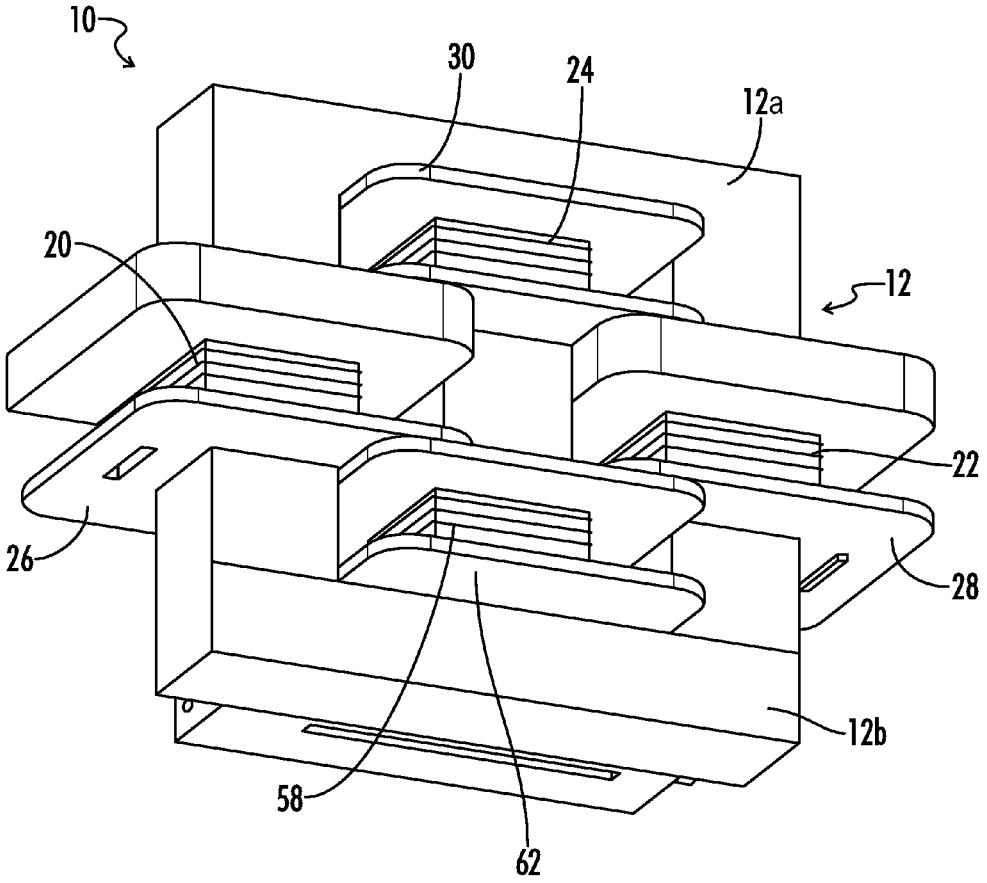
FIG. 11 is a perspective view of the device of FIG. 10 assembled.

A perspective exploded view of magnetic device 10 of FIG. 9 is shown in FIG. 10. First, second, third, and fourth bobbins 26, 28, 30, and 62 are positioned to receive first magnetic core 12*a*. First, second, third, and fourth windings 20, 22, 24, and 58 can be placed on the first, second, third, and fourth bobbins 26, 28, 30, and 62 respectively. First magnetic core 12*a* can be inserted through the bobbins and mated with second magnetic core 12*b* to form magnetic device 10. A perspective view of the assembled magnetic device of FIG. 10 is shown in FIG. 11.

Figure 12:
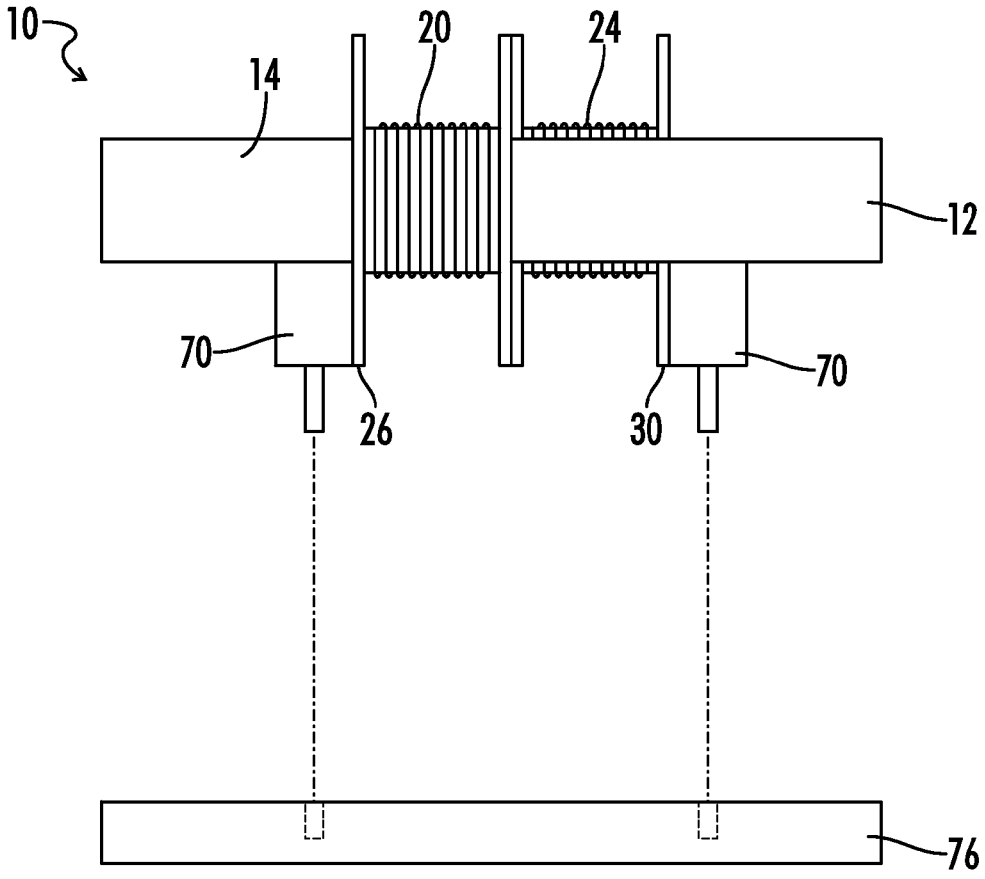
FIG. 12 is a side view of an embodiment of a magnetic device including a printed circuit board.

The magnetic device of FIG. 1 is shown in FIG. 12 connected to a printed circuit board 76. FIG. 12 is a side view of magnetic device 10. As such, only first leg 14 is shown, with second and middle legs 16 and 18 of FIG. 1 positioned behind first leg 14. Similarly, in FIG. 9 only first and third windings 20 and 24 are shown, with second winding 22 of FIG. 1 being positioned behind first winding 20.

Printed circuit board 76 in FIG. 9 can be electrically connected to the first, second and third windings 20, 22, and 24 (second winding 22 has a similar connection as shown for first winding 20 in FIG. 9). In those embodiments including corresponding bobbins, first, second, and third windings 20, 22, and 24 can be connected to printed circuit board 76 via corresponding bobbins. As shown in FIG. 12, the windings can be connected to termination connectors or pins located on pin rails 70 which can then be electrically connected to printed circuit board 76.

The printed circuit board can define a variety of electrical circuits, including circuits similar to electronic ballast circuits 80 shown in FIGS. 2 and 6. As such, in some embodiments, first and second windings can be connected to an electrical circuit defined on the printed circuit board such that first and second windings can be configured to operate as a common mode choke for the electrical circuit defined on the printed circuit board. The third winding in some embodiments can also be connected to an electrical circuit defined on the printed circuit board such that the third winding can be configured to operate as a differential mode choke for the electrical circuit defined on the printed circuit board, thereby providing a common mode choke and differential mode choke on the same magnetic device. In circuits defined on the printed circuit board that include resonant inductor circuits, the third winding can also be connected to the printed circuit board such that the third winding can be configured to define a resonant inductor for the electrical circuit.

Thus, although there have been described particular embodiments of the present invention of a new and useful Multifunction Magnetic Device with Multiple Cores and Coils it is not intended that such references be construed as limitations upon the scope of this invention except as set forth in the following claims.

What is claimed is:

1. An electronic ballast circuit comprising:

an AC power source;

a positive AC rail;

a negative AC rail coupled to the AC power source;

a resonant circuit including a resonant capacitor coupled between the positive AC rail and the negative AC rail;

first and second positive lamp terminals configured to couple to respective gas discharge lamps;

first and second negative lamp terminals configured to couple the negative AC rail to respective gas discharge lamps;

a magnetic device comprising first and second magnetic cores each having an E-core configuration, the first and second magnetic cores being substantially aligned to define first, second, and middle legs extending between first and second back walls;

the first leg, second leg, middle leg, and first and second back walls having a substantially equal width;

a first winding located on the first leg, the first winding coupled between the positive AC rail and the first positive lamp terminal;

a second winding located on the second leg, the second winding coupled between the positive AC rail and the second positive lamp terminal;

a third winding located on the middle leg, the third winding coupled between the AC power source and the positive AC rail, the third winding configured to define a resonant inductor in the resonant circuit.

2. The electronic ballast circuit of claim 1, further comprising:

a first lamp coupled to the first positive lamp terminal and the first negative lamp terminal;

a second lamp coupled to the second positive lamp terminal and the second negative lamp terminal; and the first and second windings are configured to be magnetically coupled so that when current is passed through the electronic ballast circuit, the first and second windings function as startup aids for corresponding first and second lamps.

3. The electronic ballast circuit of claim 2, further comprising:

a third positive lamp terminal configured to couple to a respective gas discharge lamp;

a third negative lamp terminal configured to couple the negative AC rail to a respective gas discharge lamp;

a fourth winding located on the first leg, the fourth winding coupled between the positive AC rail and the third positive lamp terminal; and the first, second, and fourth windings are magnetically coupled so that when current is passed through the electronic ballast circuit, the first, second, and fourth windings configured to be startup aids for corresponding first, second, and third lamps.

4. The electronic ballast of claim 3, further comprising:

a fourth positive lamp terminal configured to couple to a respective gas discharge lamp;

a fourth negative lamp terminal configured to couple the negative AC rail to a respective gas discharge lamp;

a fifth winding located on the second leg, the fifth winding coupled between the positive AC rail and the fourth positive lamp terminal; and the first, second, fourth and fifth windings are magnetically coupled so that when current is passed through the electronic ballast circuit, the first, second, fourth, and fifth windings function as startup aids for corresponding first, second, third, and fourth lamps.

5. The electronic ballast of claim 4, further comprising a first bobbin on the first leg, a second bobbin on the second leg, a third bobbin on the middle leg, a fourth bobbin on the first leg, and a fifth bobbin on the second leg, wherein the first winding is located on the first bobbin, and the second winding is located on the second bobbin, the third winding is located on the third bobbin, the fourth winding is located on the fourth bobbin, and the fifth winding is located on the fifth bobbin.

6. The electronic ballast circuit of claim 1, wherein the first leg and the second leg are symmetric about the middle leg.

7. The electronic ballast circuit of claim 1, further comprising a fourth winding located on the first leg and a fifth winding located on the second leg, wherein the first, second, fourth, and fifth windings are configured to function as a common mode choke when current is passed through the electronic ballast circuit.

8. The electronic ballast of claim 7, wherein the third winding is configured to function as a differential mode choke when current is passed through the electronic ballast circuit.

* * * * *